US006524179B2

(12) United States Patent
Perkitny et al.

(10) Patent No.: US 6,524,179 B2
(45) Date of Patent: Feb. 25, 2003

(54) CYLINDRICAL COIN BANK

(75) Inventors: Jerzy Perkitny, Lakewood, OH (US); William J. Knox, Jr., Painesville, OH (US)

(73) Assignee: Mag-Nif Incorporated, Mentor, OH (US)

( * ) Notice: Subject to any disclaimer, the term of this patent is extended or adjusted under 35 U.S.C. 154(b) by 56 days.

(21) Appl. No.: 09/879,482

(22) Filed: Jun. 12, 2001

(65) Prior Publication Data

US 2002/0187740 A1 Dec. 12, 2002

(51) Int. Cl.[7] ..... G07D 3/00
(52) U.S. Cl. ..... 453/9; 453/12; 453/26
(58) Field of Search ..... 453/9, 12, 59, 453/26, 61

(56) References Cited

U.S. PATENT DOCUMENTS

| | | | | | |
|---|---|---|---|---|---|
| 1,274,615 | A | * | 8/1918 | Sherwood | 453/61 |
| 4,606,360 | A | * | 8/1986 | Mills | 453/59 |
| 5,474,496 | A | | 12/1995 | Perkitny | |
| 5,827,117 | A | | 10/1998 | Naas | |
| 5,902,178 | A | * | 5/1999 | Perkitny | 453/61 |
| 5,976,006 | A | | 11/1999 | Snyder | |
| 6,099,401 | A | | 8/2000 | Perkitny | |
| 6,099,403 | A | * | 8/2000 | Batchelder | 359/801 |

OTHER PUBLICATIONS

Mag–Nif makes it in the U.S.A.!1999 Brochure, front and back cover pp. and pp. 1–16.

* cited by examiner

*Primary Examiner*—Kathy Matecki
*Assistant Examiner*—Michael J. Kwon
(74) *Attorney, Agent, or Firm*—Fay, Sharpe, Fagan, Minnich & McKee, LLP

(57) ABSTRACT

A coin bank (A) having one or more coin holders (70A–70D) removably aligned with one or more coin chutes (56A–56D) for receiving coins therefrom. The coin bank (A) preferably includes a coin sorter assembly (32) for sorting coins by diameter, a separator assembly (30) for conveying coins one at a time to the coin sorter assembly (32), a coin chute assembly (54) including the one or more coin chutes (56A–56D) each accommodating coins of a respective maximum diameter. The one or more coin chutes (56A–56D) each include at least one finger for abutting the top edge of the corresponding coin holder (70A–70D) for maintaining the alignment. An overflow passage (62) is defined in the wall of at least one of the coin chutes (56A–56D) for allowing coins to pass therethrough when the associated coin holder (70A–70D) is filled with coins. The coin bank further includes a housing (20) preferably having a light transmitting portion (22), a motor (44) for moving the separator assembly (30), a light emitting device (80) and one or more switches (52) for activating the light emitting device (80) and motor (44).

40 Claims, 13 Drawing Sheets

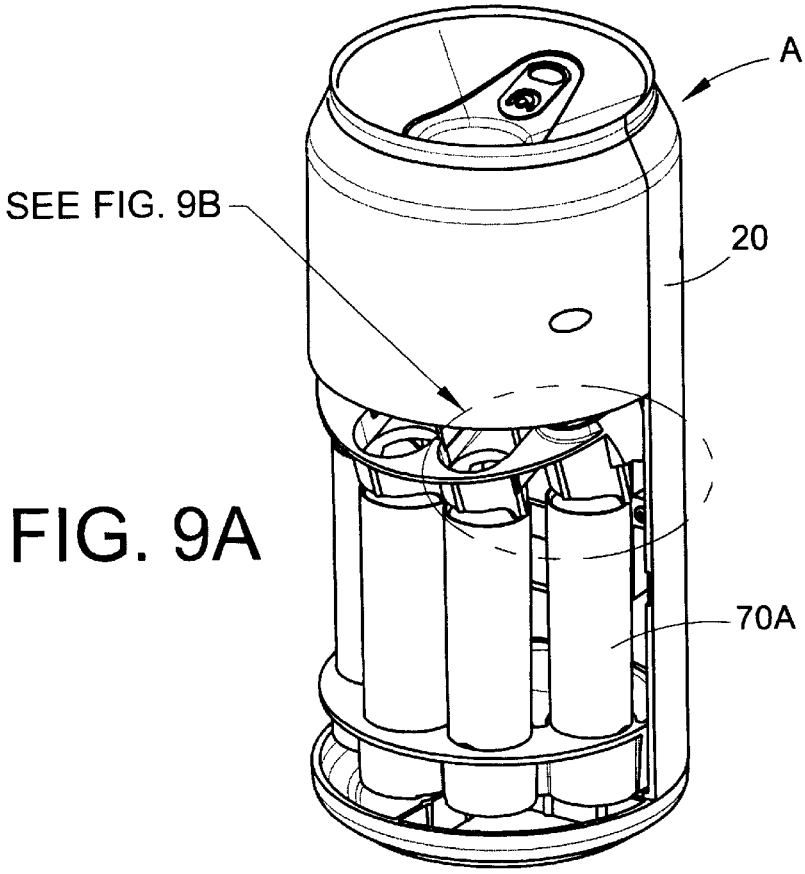
FIG. 9A
FIG. 9B
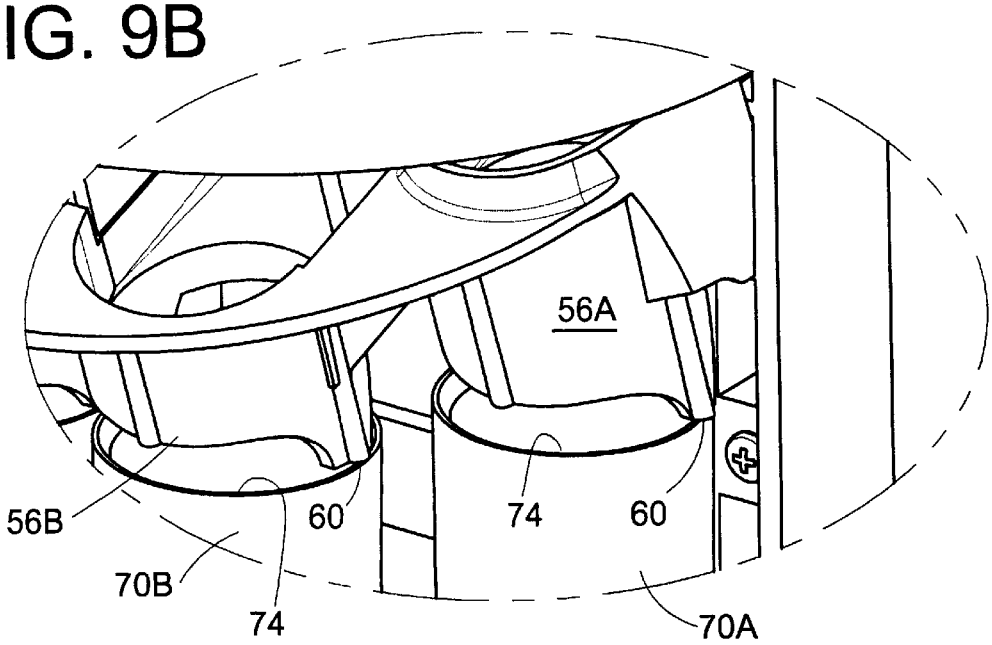

CYLINDRICAL COIN BANK

BACKGROUND OF THE INVENTION

The present invention relates to a coin bank for storing coins in removable coin holders. More particularly, it relates to a coin bank having removable coin holders which can be quickly and easily aligned with corresponding coin chutes for receiving coins therefrom. The invention provides pleasing visual effects for the operator using light and motion.

Coin banks are commonly known. Some coin banks include sorting devices for sorting and storing coins of various diameters. A user places one or more coins in a hopper or similar coin receiver. A coin separating mechanism separates the coins and dispenses them one at a time into a coin sorting mechanism. The coin sorting mechanism sorts the coins by their diameter. Coins of a particular diameter, and consequently of a particular denomination, are directed to a corresponding coin chute. An appropriately sized sorted coin holder is aligned with the coin chute for receiving the sorted coins.

Conventional sorted coin holders typically hold finite numbers of coins. Once a coin holder is filled to capacity, the coin sorting must be stopped to allow for the removal of the coins, or the excess coins must be redirected elsewhere. It is desirable to prevent the interruption of the sorting operation when one or more of the coin holders are filled to capacity.

Some coin sorting devices have sorted coin holders which can be removed to facilitate the retrieval of coins from the holders. It is desirable to provide coin holders which can be quickly and accurately aligned with corresponding coin chutes for receiving coins during sorting.

Most coin sorting devices utilize movement during the sorting operation. For example, coins are typically moved from the coin receiver to the sorted coin holders. Also, many coin sorting devices utilize parts which move during the sorting operation, such as a moving coin separator. It is desirable to highlight this movement to improve the visual effects of the coin sorter thereby providing a pleasing sorting experience for the operator.

Accordingly, it has been considered desirable to develop a new and improved coin bank which would overcome the foregoing difficulties and meet the above-stated needs while providing better and more advantageous results.

SUMMARY OF THE INVENTION

According to the present invention, a new and improved coin bank is provided.

In accordance with a first aspect of the invention, the coin bank includes a housing and a coin holder removably secured to the housing for holding a predetermined number of coins of a specific maximum diameter. A coin chute accommodating coins of a specific maximum diameter is aligned with the coin holder for conveying coins thereto. The coin chute includes at least one protrusion extending therefrom for abutting the top edge of the coin holder to maintain the alignment. The coin chute further includes an overflow passage defined in a wall of the coin chute for allowing coins in excess of the predetermined number to pass therethrough when the coin holder is filled with the predetermined number of coins.

In accordance with another aspect of the invention, the coin bank includes a housing, a coin tray selectively mounted to the housing and a coin holder disposed in coin tray. The coin bank also includes a coin chute accommodating coins of a specific diameter and aligned with the coin holder for conveying coins thereto. The coin chute includes at least one protrusion extending therefrom for abutting the top edge of the coin holder to maintain the alignment.

In accordance with still another aspect of the invention, the coin bank sorts and stores coins of various diameters. The coin bank includes a housing and a sorter supported by the housing for sorting coins of different diameters. The coin bank also includes a sorted coin holder removably secured to the housing and adapted for holding sorted coins of a specific maximum diameter. The sorted coin holder is removably aligned with a coin chute for receiving the sorted coins therefrom. The coin chute includes at least one protrusion for abutting the top edge of the sorted coin holder for maintaining the alignment while coins are conveyed thereto. The protrusion also accommodates the displacement of the sorted coin holder from the alignment for the removal of coins therefrom. The coin chute further includes an overflow passage defined in a wall of the chute for allowing the sorted coins to pass therethrough when the coin holder is full.

In accordance with yet another aspect of the present invention, the coin bank sorts and stores coins of various sizes and includes a housing having a light transmitting portion for allowing light to pass therethrough. A separator and sorter mechanism is disposed within the housing. Also a light emitting device is disposed within the housing for providing illumination of the separator and sorter mechanism which is visible from outside of the housing.

In accordance with yet another aspect of the present invention, the coin bank sorts and stores coins of various sizes and includes a housing. A sorter is secured to the housing and includes a plurality of different sized apertures for sorting the associated coins by diameter. The coin bank also includes a separator and an electric motor for moving the separator to convey the associated coins individually to the sorter. A light emitting device is connected to the housing, and a switch activates the electric motor and the light emitting device.

In accordance with yet another aspect of the present invention, the coin bank includes a housing having a light transmitting portion for allowing light to pass therethrough. The housing also includes a movable top portion. A light emitting device is disposed within the housing for providing illumination which is visible from outside of the housing. A switch is supported by the housing for activating the light emitting device when the top portion is moved.

Other features, benefits and advantages of this invention will become apparent to those skilled in the art from the following detailed description of the preferred embodiments, when read in light of the accompanying drawings.

BRIEF DESCRIPTION OF THE DRAWINGS

The invention may take form in certain components and structures, preferred embodiments of which will be illustrated in the accompanying drawings wherein:

FIG. 9A is a reduced perspective view of the coin bank shown in FIG. 1 with a portion of the housing removed;

FIG. 9B is an enlarged perspective view of the coin chutes and coin holders shown in FIG. 9A;

DETAILED DESCRIPTION OF THE INVENTION

It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting.

Figure 1:
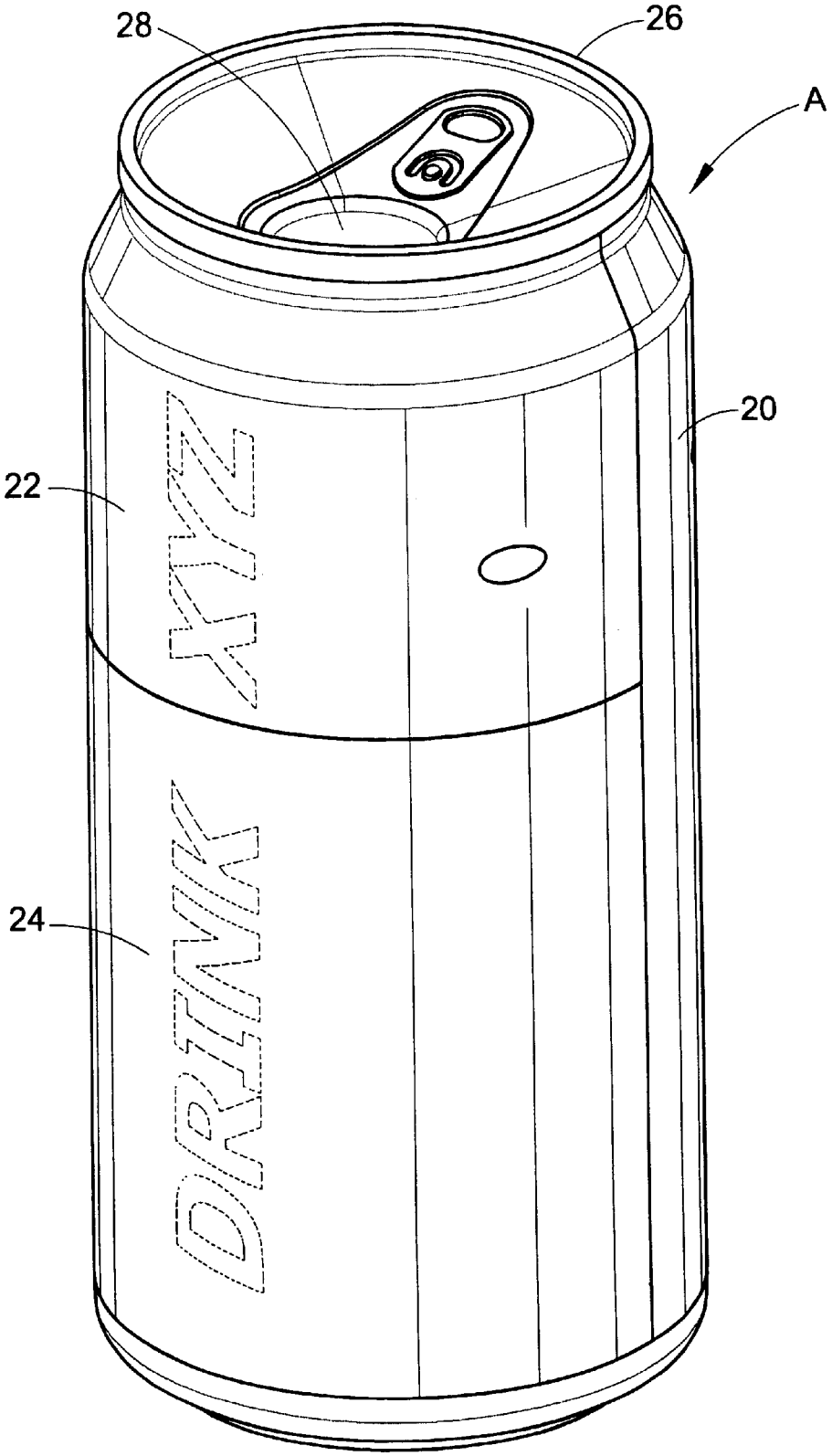
FIG. 1 is a perspective view of a coin bank for sorting coins in accordance with a first preferred embodiment of the present invention.

Referring now to FIG. 1, a coin bank for sorting and storing coins of various sizes, shown generally at A, includes a housing 20 made from plastic or a similar conventional material. The housing 20 includes a light transmitting portion 22, either translucent or transparent, for allowing light to pass therethrough. As shown herein, the housing 20 is preferably made from a transparent plastic such that the operation of the apparatus can be easily viewed by an operator or a bystander. The housing preferably includes indicia 24, which may include any letters, numbers, symbols, or graphics desired. The housing further includes a top portion 26 having a coin aperture 28 for receiving coins.

Figure 2:
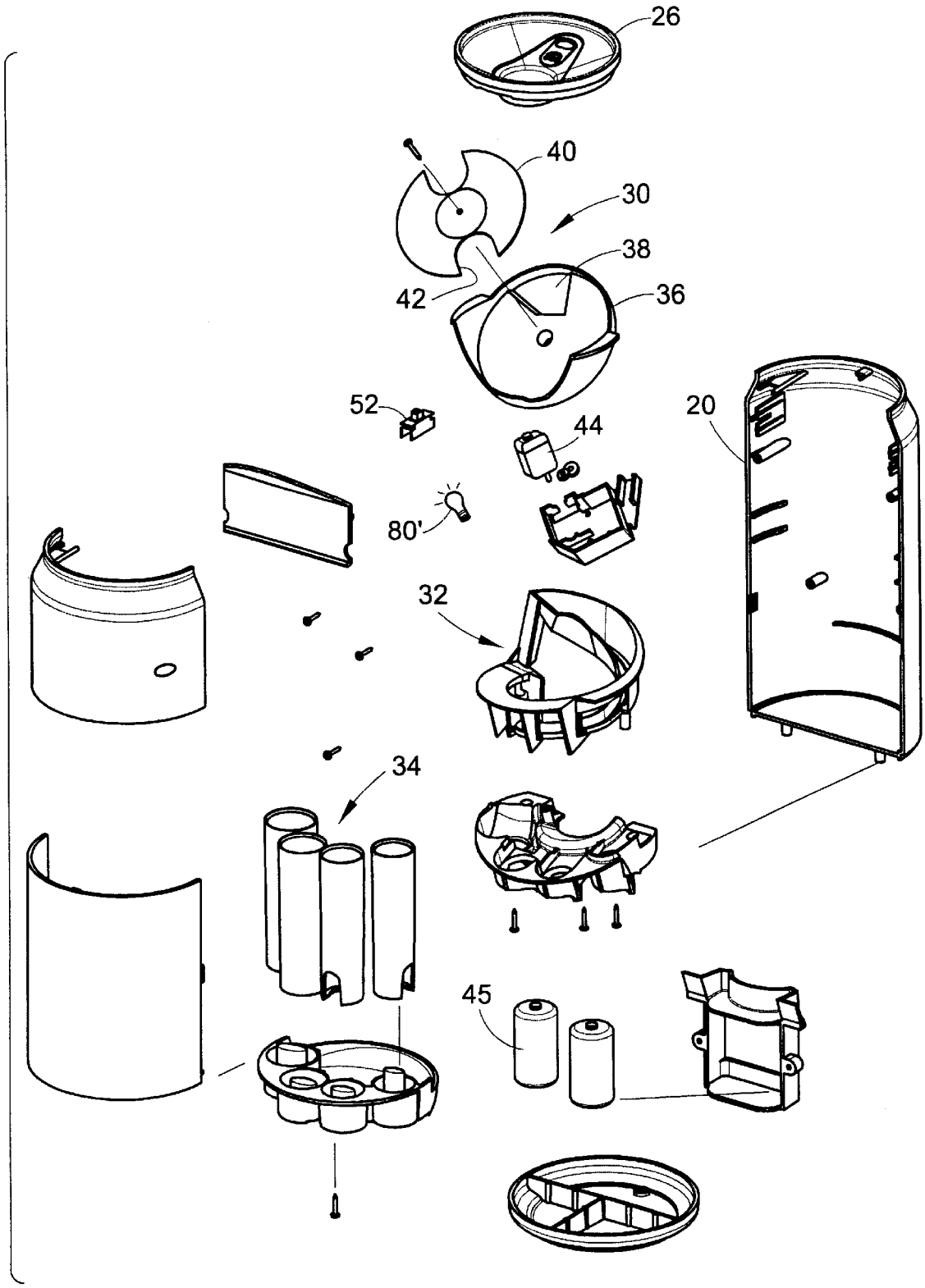
FIG. 2 is a reduced exploded perspective view of the coin bank shown in FIG. 1.
Figure 3:
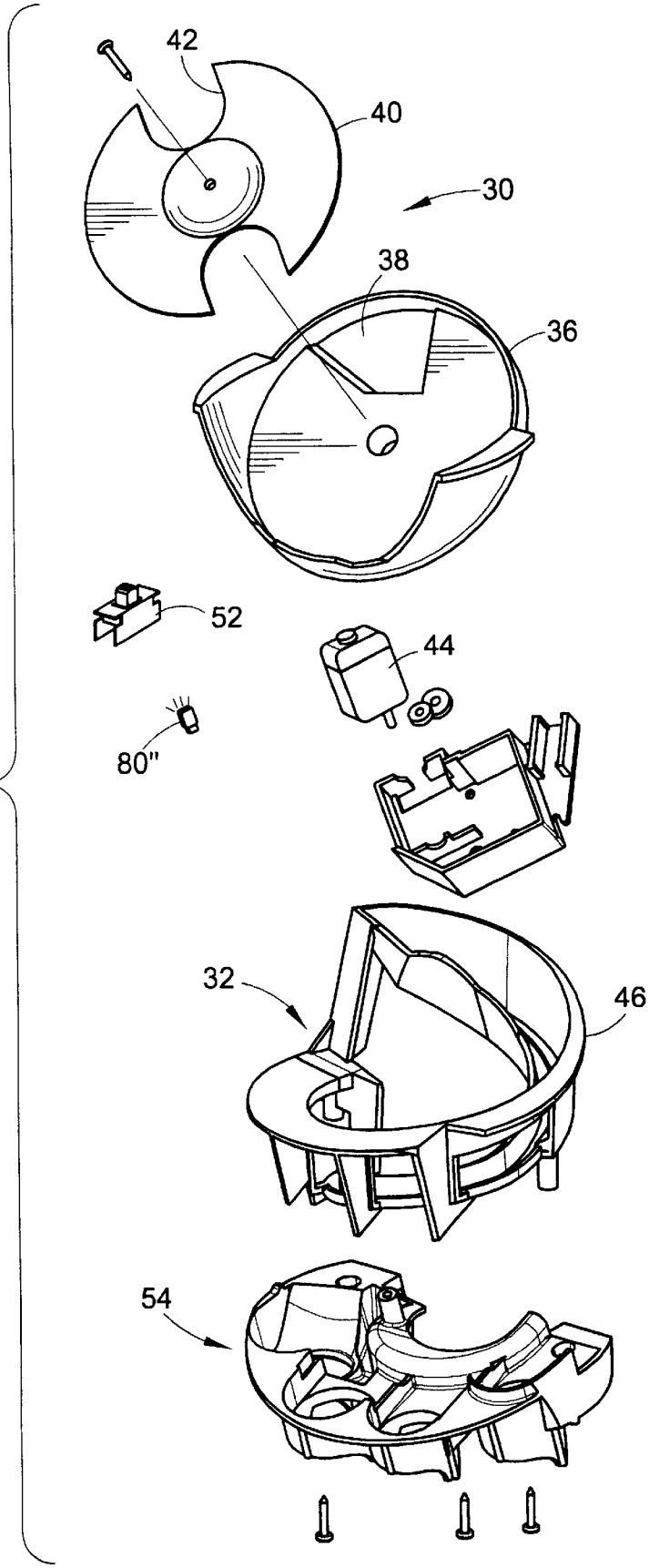
FIG. 3 is an exploded perspective view of an upper portion of the coin bank shown in FIG. 1.

Referring now to FIGS. 2 and 3, the coin bank further includes a coin separator assembly shown generally at 30, a coin sorter assembly shown generally at 32, and a coin storage assembly shown generally at 34. The general construction and operation of the coin separator assembly 30 and the coin sorter assembly 32 is described in U.S. Pat. No. 5,474,496 issued Dec. 12, 1995 and assigned to the assignee of the present application, said patent being expressly incorporated in its entirety by reference herein.

Figure 4:
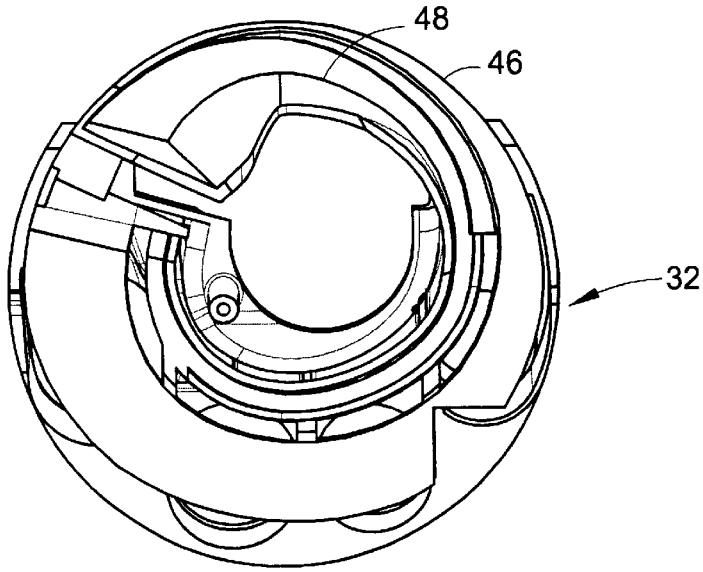
FIG. 4 is a top plan view of a coin ramp and coin chute assembly as used in the coin bank of the present invention.

Briefly, the coin separator assembly 30 includes a coin receiver 36 having a coin opening 38, a separator wheel 40 mounted in the coin receiver and having one or more U-shaped notches 42, and a motor 44 drivingly connected to the separator wheel. The motor is powered by batteries 45, although alteratively a conventional household current supply or any other suitable known power supply may be used. The coin sorter assembly 32, as shown in FIGS. 4 and 5, includes a helical coin ramp 46 having a sloped coin path 48 with a plurality of apertures 50A, 50B, 50C, 50D of varying sizes formed thereon.

Coins to be sorted and stored are placed in the bank A through the coin opening 28 and fall into the coin receiver 36. The coin separator assembly 30 operates to convey coins one at a time from the coin receiver 36 to the coin sorter assembly 32. Upon actuation of a switch 52 (to be described in further detail below), the motor 44 rotates the separator wheel 40 and coins are conveyed by the notches 42 to the coin opening 38 where they fall into the coin separator assembly 32.

Each coin conveyed to the coin separator assembly 32 enters helical coin ramp 46, rolls down the sloped coin path 48, and is sorted by diameter by falling through an appropriately sized aperture 50A–50D. The coin separator assembly 30 and coin sorter assembly 32 are shown herein by way of example, however any suitable known coin separator for conveying coins to the coin sorter and any suitable known coin sorter having apertures for sorting coins by diameter may be used.

Figure 5:
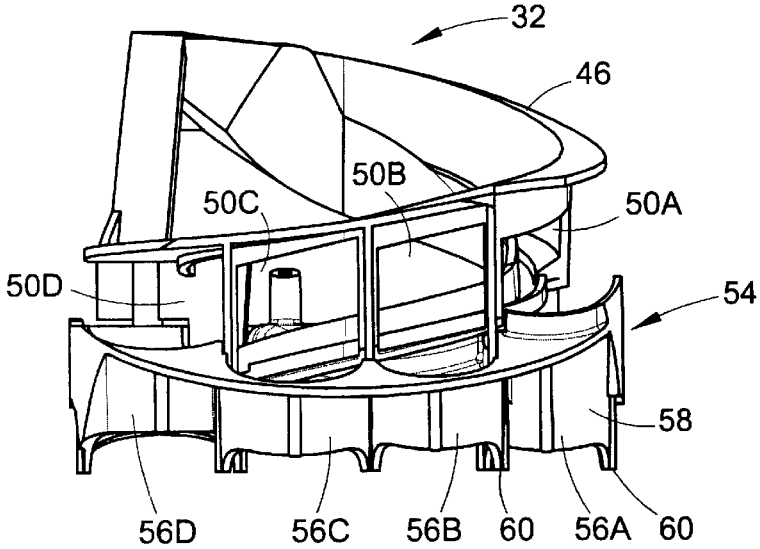
FIG. 5 is a side elevational view of the coin ramp and coin chute assembly as used in the coin bank of the present invention.
Figure 6:
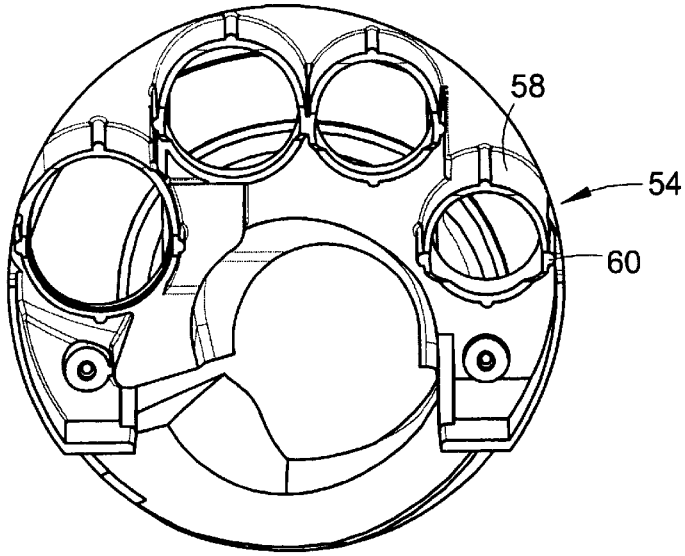
FIG. 6 is a bottom plan view of the coin ramp and coin chute assembly as used in the coin bank of the present invention.
Figure 12:
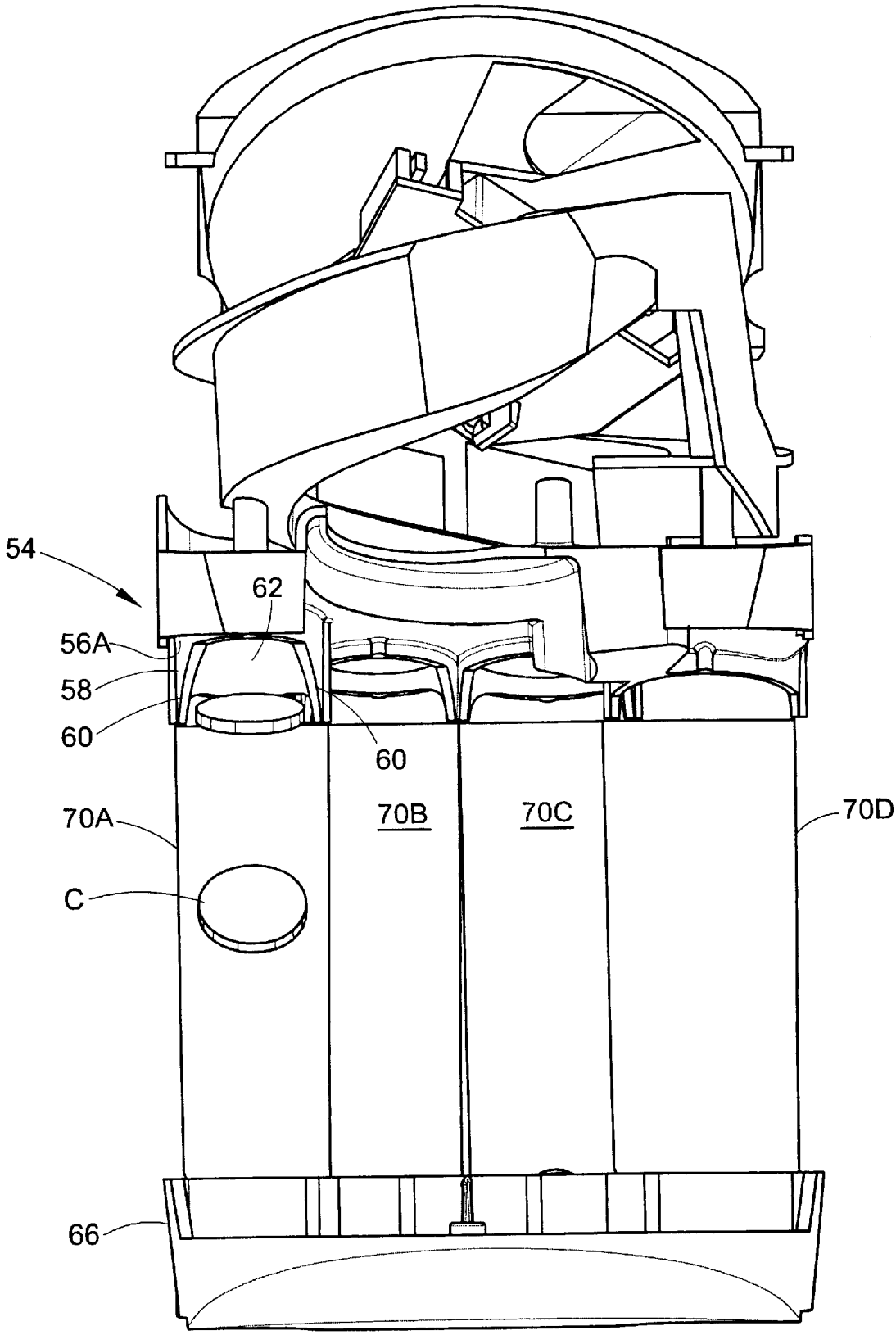
FIG. 12 is a rear elevational view of a coin separator, coin sorter and coin storage assembly of the embodiment of the invention shown in FIG. 1.
Figure 13:
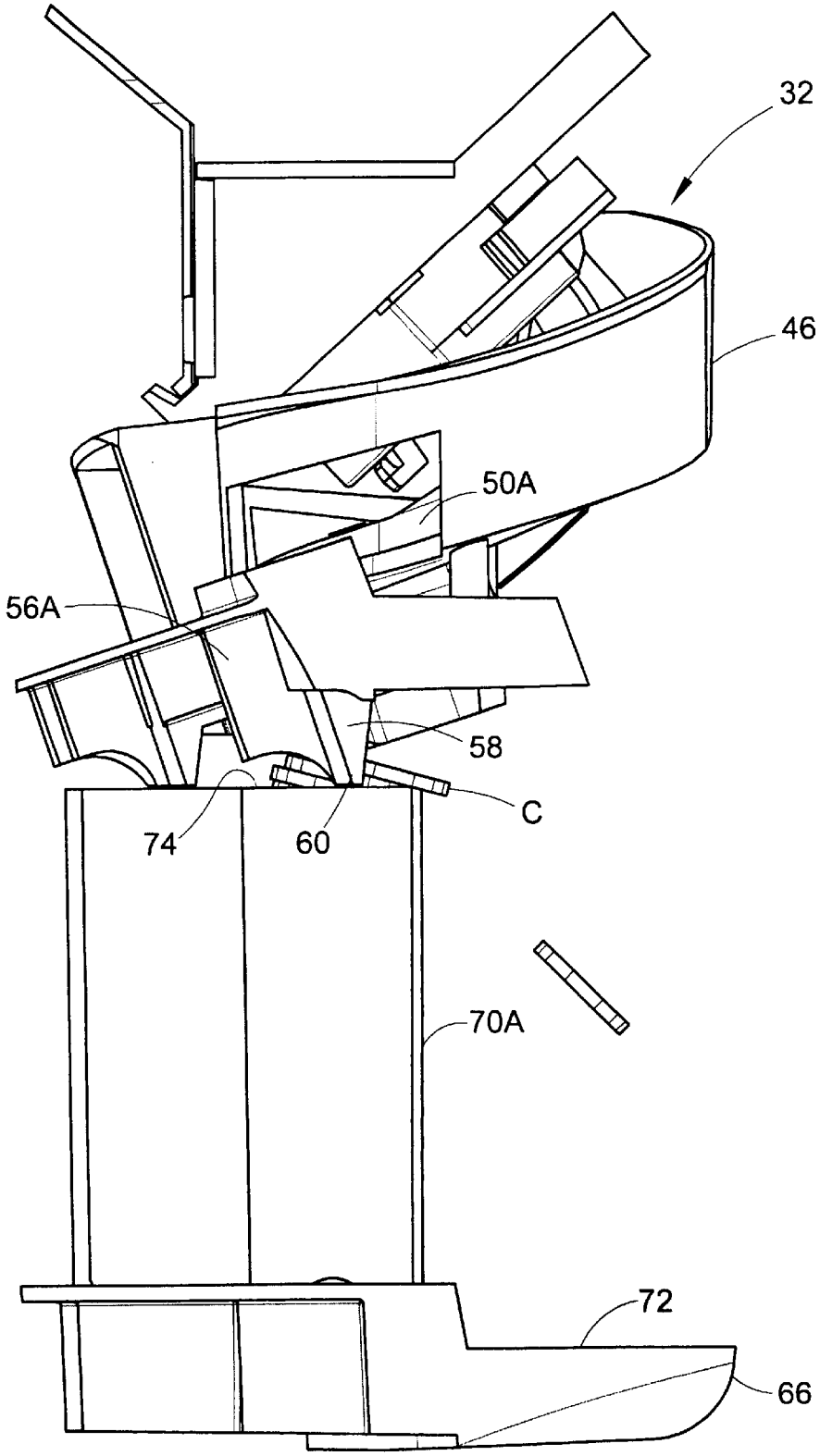
FIG. 13 is a side elevational view of a coin separator, coin sorter and coin storage assembly of the embodiment of the invention shown in FIG. 1.
Figure 14:
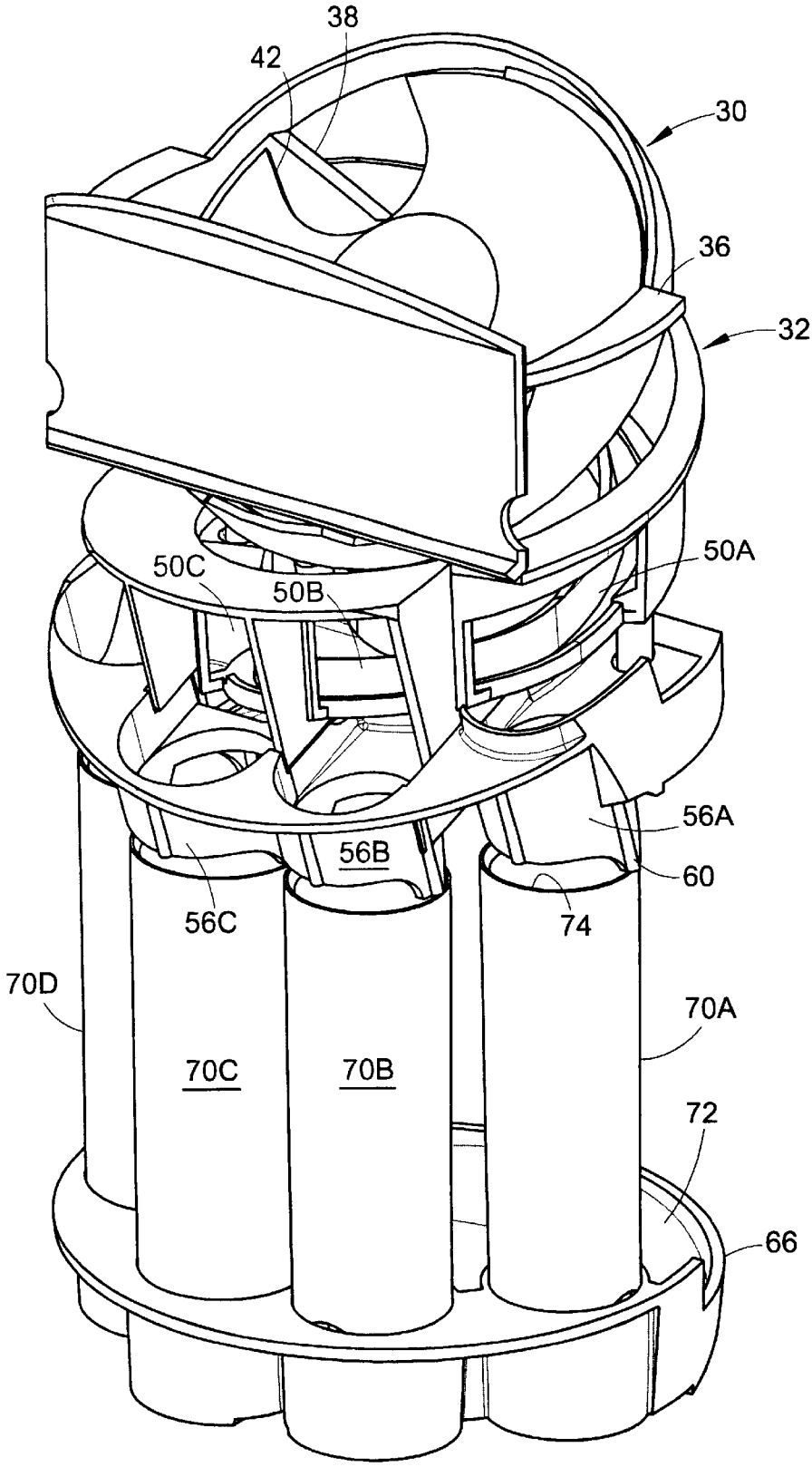
FIG. 14 is a perspective view of the coin separator, coin sorter and coin storage assembly of the embodiment of the invention shown in FIG. 1.

Referring now to FIGS. 5, 6 and 12, the coin bank A of the present invention also includes a coin chute assembly shown generally at 54 for directing sorted coins from the coin sorter assembly 32 to the coin storage assembly 34 as described in further detail below. The coin chute assembly 54 is preferably disposed beneath the coin sorter assembly 32 and between the coin chute assembly 32 and the coin storage assembly 34. The coin chute assembly 54 includes a plurality of individual coin chutes 56A–56D, each aligned with a corresponding coin sorter aperture 50A–50D for receiving sorted coins of a particular diameter therefrom.

Each coin chute 56A–56D includes similar structural components and therefore, for simplicity, only a single coin chute 56A shall be described in further detail. The coin chute 56A preferably includes a cylindrical wall 58 having a diameter which is only slightly larger than the diameter of the respective sorted coins it receives.

The coin chute 56 further includes one or more protrusions 60, preferably formed as fingers, extending downwards from the lower end of the coin chute wall 58. The preferred embodiment of the invention includes a pair of fingers 60 disposed on opposite sides of the lower end of the coin chute 56A, although any suitable number may be used. An overflow passage 62 is defined in the lower end of the coin chute wall 58, preferably disposed between each pair of downwardly extending fingers 60.

Figure 7:
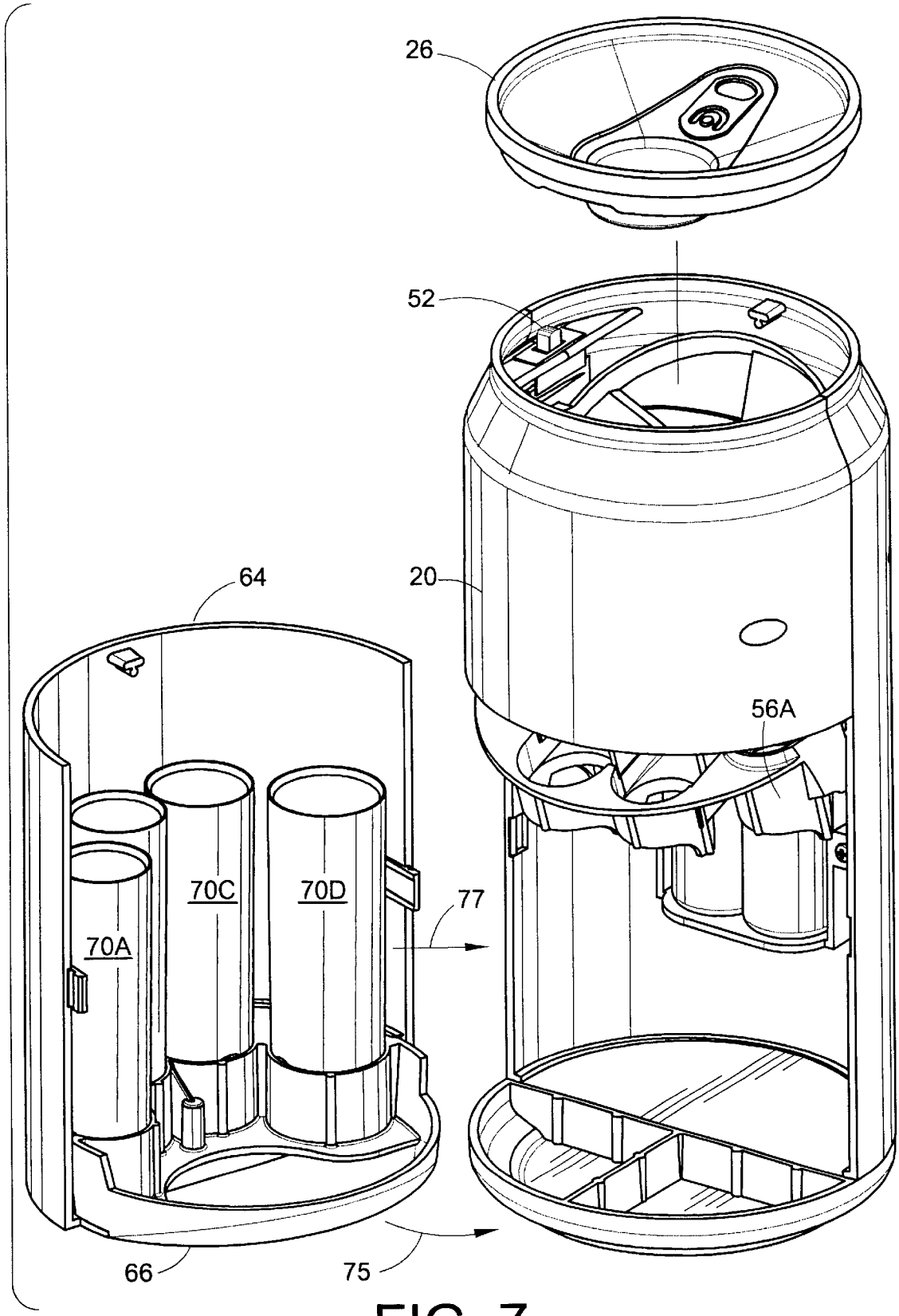
FIG. 7 is a partial exploded perspective view of the coin bank shown in FIG. 1 illustrating a removable coin storage assembly.
Figure 8:
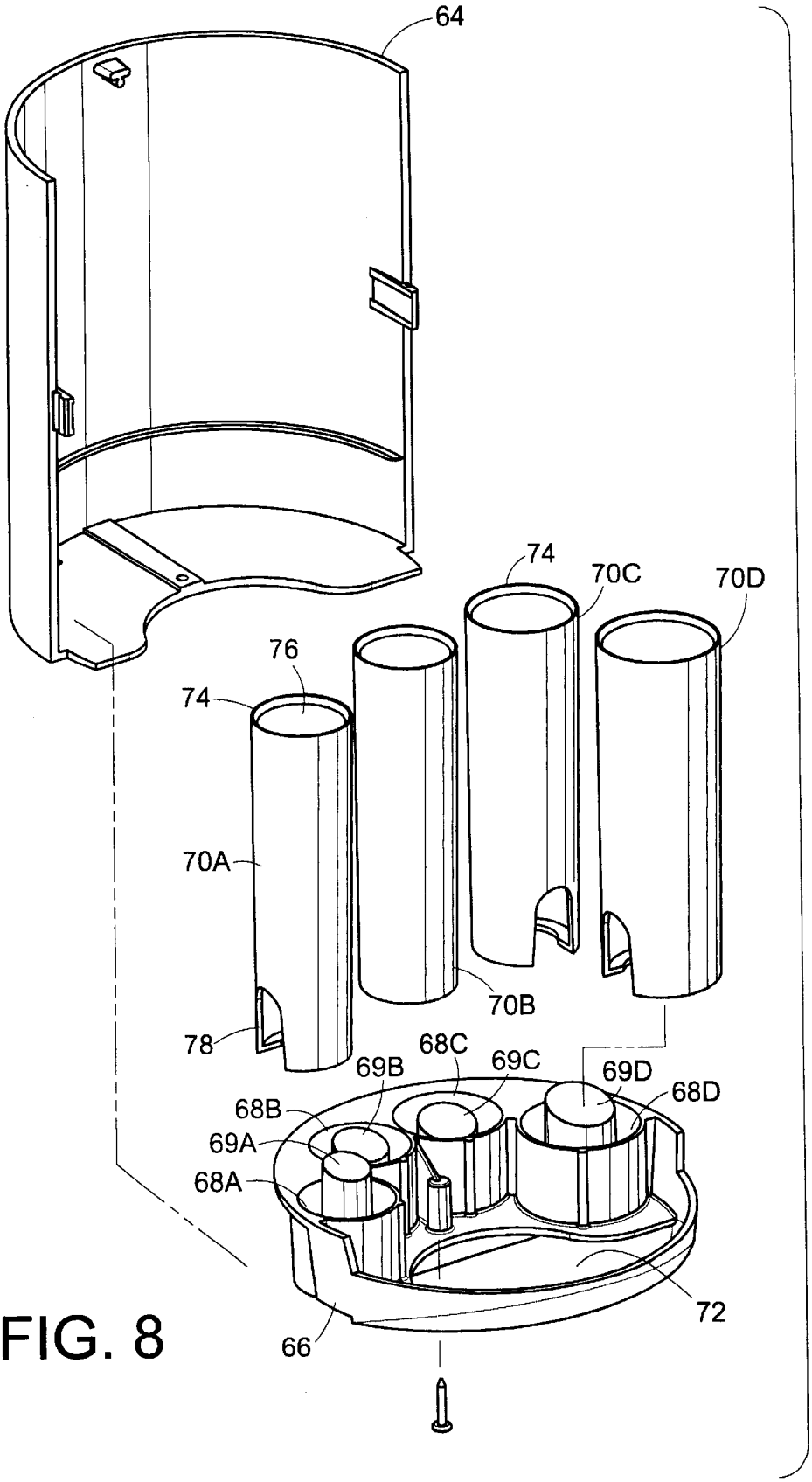
FIG. 8 is an exploded perspective view of the coin storage assembly shown in FIG. 7 illustrating removable sorted coin holders.

With reference now to FIGS. 7 and 8, the coin storage assembly includes a lower housing portion 64 having a coin tray 66 extending therefrom. The coin tray 66 includes a plurality of coin wells 68A–68D each having a wedge, 69A–69D respectively, extending therefrom. The coin wells 68A–68D are each adapted to receive a corresponding sorted coin holder 70A–70D removably disposed therein. The wedges 69A–69D extend into the sorted coin holders 70A–70D when they are disposed within the coin wells as shall be described in further detail below. The coin tray 66 also includes an overflow bin 72 for holding excess coins.

Each sorted coin holder 70A–70D includes similar structural components and therefore, for simplicity, only a single sorted coin holder 70A shall be described in further detail. Preferably, as shown herein, the sorted coin holder 70A is provided in the form of hollow cylindrical tube having a top edge 74 defining an open upper end for receiving coins and an at least partially closed lower end 78. The coin holder tube 70A has a diameter which is only slightly larger than the diameter of the sorted coin stored therein such that the coins deposited therein stack into a column formation.

Each sorted coin holder 70A–70D holds a respective predetermined number of sorted coins of a particular diameter. For example, coin holder 70A is adapted to hold fifty dimes, coin holder 70B is adapted to hold fifty pennies, coin holder 70C is adapted to hold forty nickels and coin holder 70D is adapted to holder forty quarters. However the coin holders 70A–70D may be adapted to hold any predetermined number of coins of any suitable diameter and denomination. The tubes can receive a conventional coin wrapper (not shown) in which to package the sorted coins.

The coin storage assembly 34 is removably secured to the coin bank housing 20 to bring the coin holders 70A–70D into an aligned position for receiving sorted coins during sorting. To achieve the aligned position, the lower housing portion 64 is brought into engagement with the remainder of the housing 20 thereby sliding the coin tray 66 into the housing 20 as shown by arrow at 75 in FIG. 7. As the coin tray 66 is slid into the housing 20, the cylindrical coin tubes 70A–70D are moved in a generally orthogonal direction, as shown by arrow 77, beneath the corresponding coin chutes. As shown in FIG. 9B, the protrusions 60 extending from the coin chutes 56A–56D advantageously accommodate the coin holders 70A–70D as they slide into alignment with their respective coin chutes 56A–56D.

In the aligned position, the protrusions 60 abut the top edges 74 of the coin holders 70A–70D to maintain the proper alignment as exemplified by coin holder 70A and coin chute 56A shown in FIGS. 9A and 9B. The protrusions 60 advantageously enable the coin bank to be moved or tilted without disrupting the alignment between the coin chutes 56A–56D and the respective coin holders 70A–70D.

Figure 10:
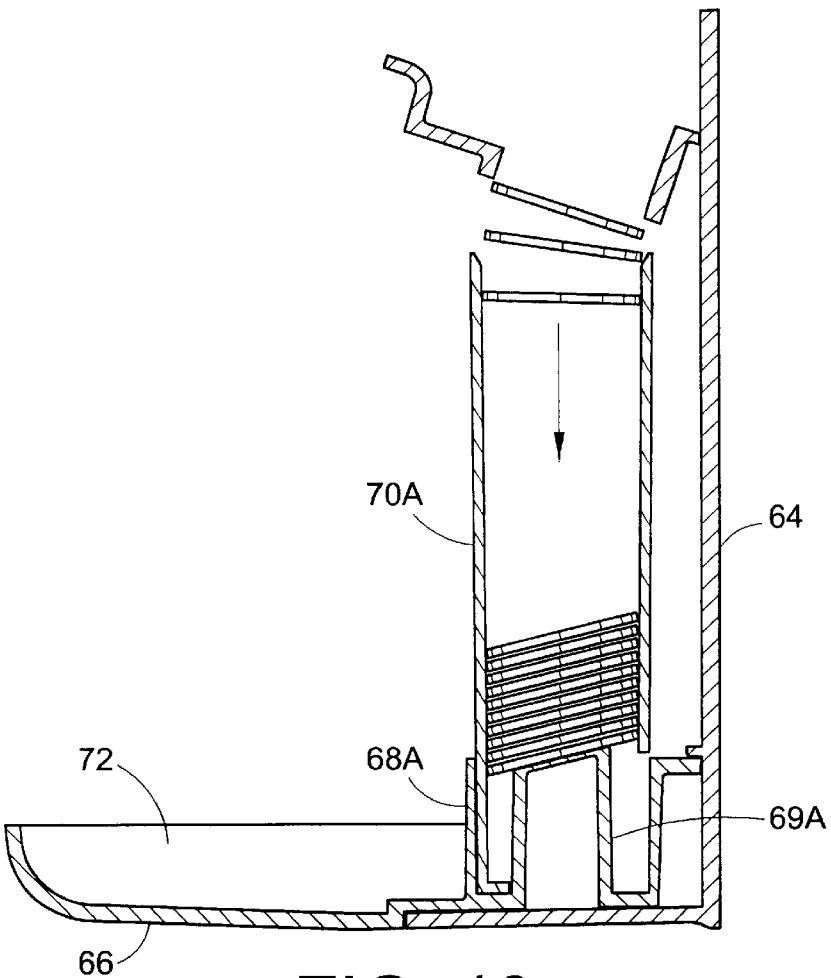
FIG. 10 is an enlarged cross sectional planar view of the coin chute and coin holder of the embodiment of the invention shown in FIG. 1.

During the sorting operation described above and with the coin holders 70A–70D disposed in the aligned position as shown in FIGS. 10–13, each sorted coin C falling through a specific sorting aperture 50A–50D falls into the corresponding chute 56A–56D disposed therebelow. Each coin chute 56A–56D directs coins of a particular diameter into a corresponding coin holder 70A–70D which is aligned with the chute for receiving the respective coins in a stacked formation as shown in FIG. 10.

Figure 11:
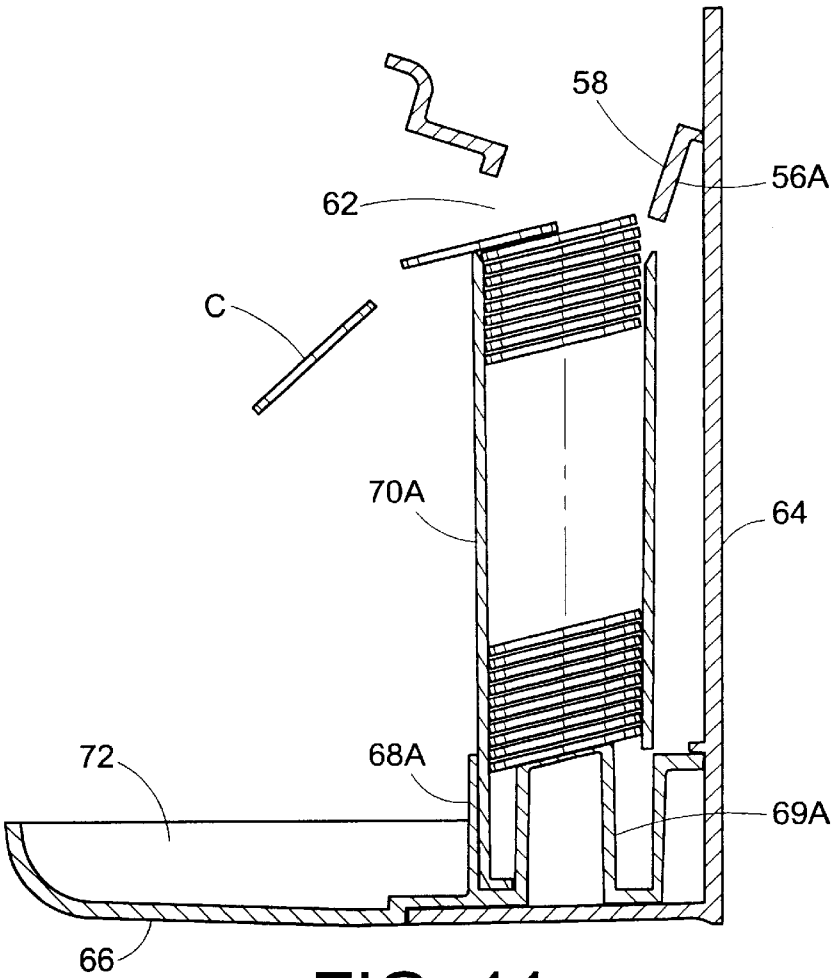
FIG. 11 is a cross sectional planar view showing the excess coin runoff of the coin chute and coin holder shown in FIG. 10.

Wedges 69A–69D extend into the coin holders 70A–70D causing the coins stacked therein to be tilted as shown in FIG. 10. Coins in excess of the predetermined number described above entering the coin chute 56A–56D, that is those coins exceeding the capacity of the coin holder 70A–70D, fall from the tilted stack and are redirected through the overflow passage 62 and into the overflow bin 72 in the coin tray 66, as shown in FIG. 11. Redirection of excess coins through the overflow passages 62 advantageously prevents untimely interruption of the sorting operation.

After the coins placed in the coin receiver 36 have been sorted, the coin storage assembly 34 can be separated from the housing 20 and the sorted coin holders 70A–70D can be separated from the coin tray 66 for the removal of the stacked sorted coins. Any excess coins in the overflow bin 72 can simply be resorted after emptying the filled coin holders 70A–70D and returning the coin holders 70A–70D to the aligned position.

With reference again to FIG. 2, the coin bank A also includes a light emitting device 80 (FIG. 15), for selectively illuminating various components of the coin bank A which can be viewed through the light transmitting portion of the housing 22. The light emitting device 80 can be a light bulb 80' as shown in FIG. 2. Alternatively, it may be a light emitting diode 80" as shown in FIG. 3, or any other suitable known light emitting device. The light emitting device 80 is preferably disposed within the housing 20, although alternatively it may be disposed on the housing or outside it. The light emitting device 80 illuminates the housing 20, preferably from within, which advantageously highlights the indicia 24 on the housing 20. The indicia 24 are preferably opaque, and thus the light seen through the light transmitting portion of the housing highlights the indicia 24. Alternatively, the indicia 24 may transmit light therethrough for different pleasing visual effect.

Figure 15:
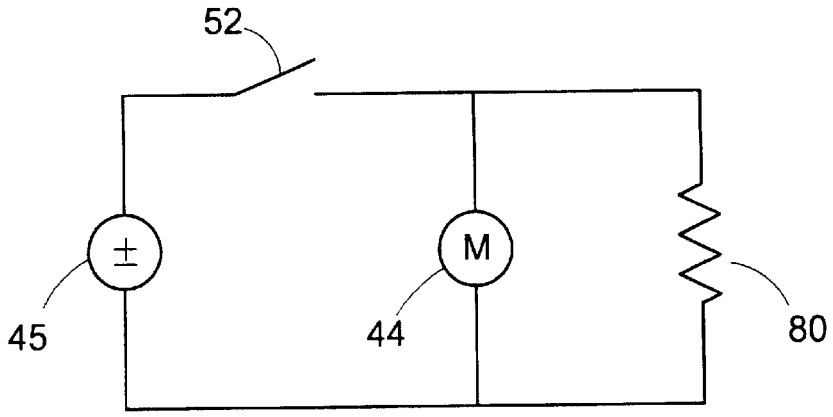
FIG. 15 is an electrical circuit schematic for the embodiment of the invention shown in FIG. 1.

The light emitting device 80 is illuminated by closure of the switch 52 thereby completing the electrical circuit shown in FIG. 15. Closing the switch 52 preferably simultaneously illuminates the light emitting device 80 and actuates the motor 44 during the sorting operation to provide an esthetically pleasing sorting event. Alternatively, the actuation of the light emitting device 80 and motor 44 may be initiated at different times by one or more switches.

Figure 16:
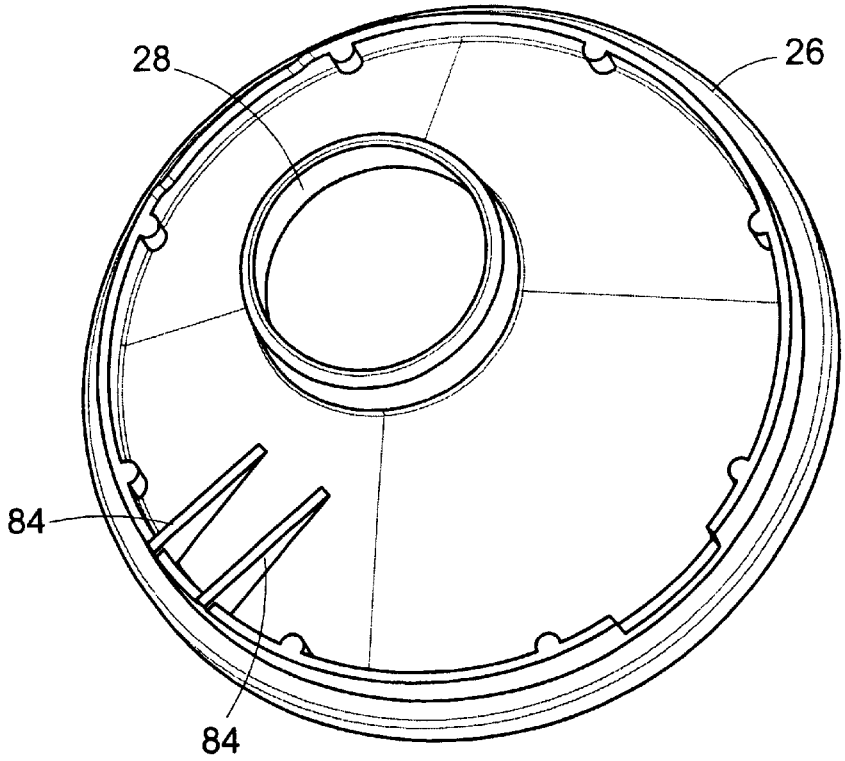
FIG. 16 is a perspective view of a bottom face of the top portion of the coin bank illustrating spaced projections in accordance with the present invention.
Figure 17:
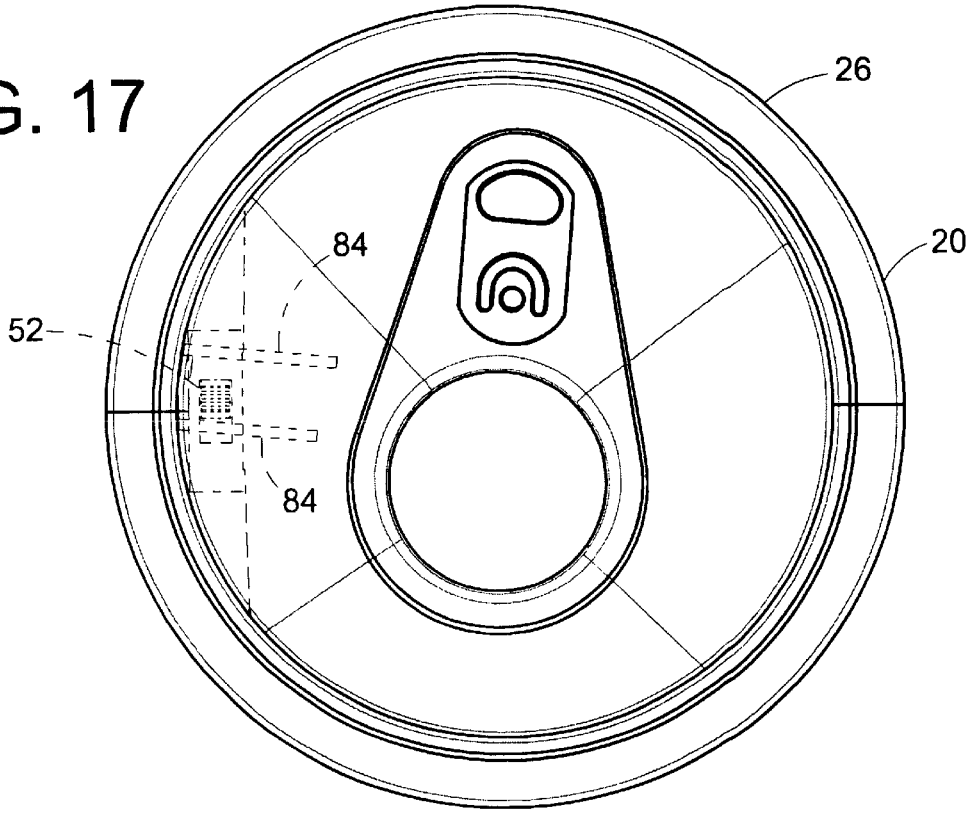
FIG. 17 is a top plan view of the top portion of the coin bank illustrating the projections (shown in phantom) interacting with a switch in accordance with the present invention.
Figure 18:
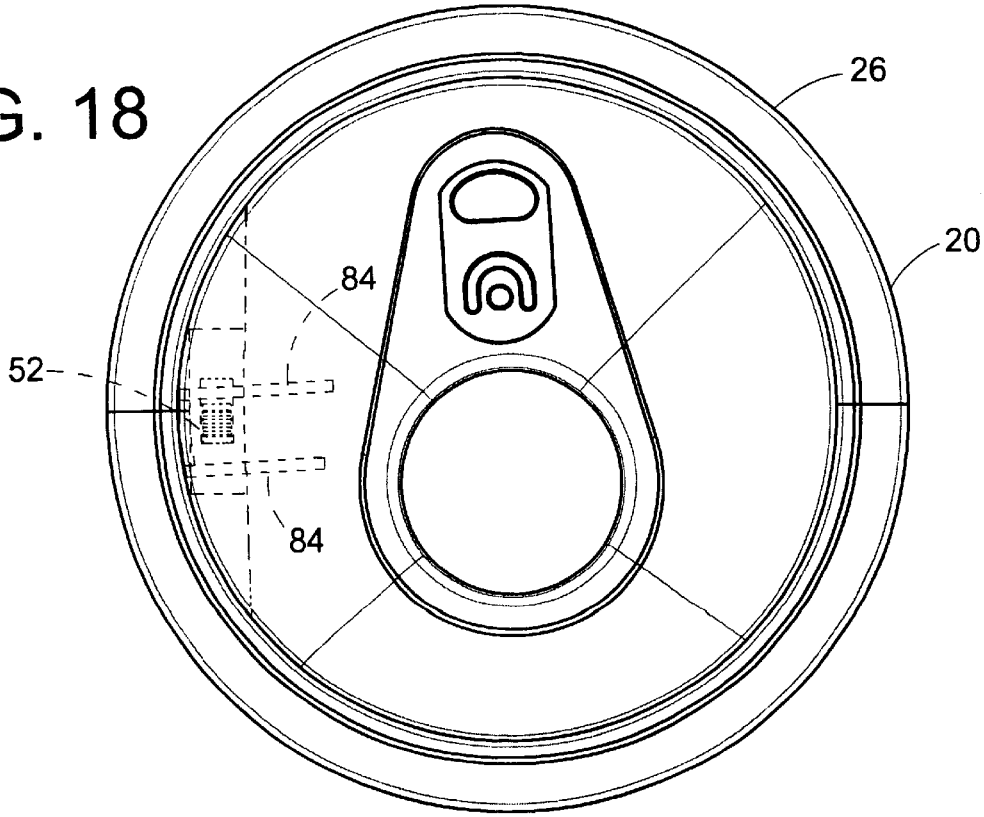
FIG. 18 is a top plan view of the top portion of the coin bank illustrating the projections (shown in phantom) interacting with the switch in accordance with the present invention.

Referring now to FIGS. 1, and 16–18, the preferred embodiment of the coin bank A includes a moveable top portion 26, which can be a lid adapted for rotation, disposed on top of the housing 20. As shown in FIG. 16, the lid 26 includes a pair of spaced projections 84 extending from a lower face thereof for abutting opposing sides of the switch 52. In the preferred embodiment, rotational movement of the lid by the user selectively moves the switch between the open and closed positions as shown in FIGS. 17 and 18. However, those skilled in the art will recognize that a wide variety of switch means exist for selectively providing power to the light emitting device 80 and motor 44 and the present invention is not meant to be limited to the particular switching arrangement shown herein.

The invention has been described with reference to preferred embodiments. Obviously, modifications and alterations will occur to others upon reading and understanding the preceding specification. It is intended that the invention be construed as including all such modifications and alterations insofar as they come within the scope of the appended claims or the equivalents thereof.

What is claimed is:

1. A coin bank, said coin bank comprising:

a housing;

a coin holder removably secured to said housing for holding a predetermined number of coins of a specific maximum diameter;

a coin chute accommodating coins of a specific maximum diameter and aligned with said coin holder for conveying coins thereto, said coin chute including at least one protrusion extending therefrom for abutting the top edge of said coin holder to maintain said alignment, said coin chute further including an overflow passage defined in a wall of said coin chute for allowing coins in excess of said predetermined number to pass therethrough when said coin holder is filled with said predetermined number of coins.

2. The coin bank defined in claim 1 wherein said protrusion is a finger.

3. The coin bank defined in claim 1 wherein said overflow passage is defined adjacent said protrusion.

4. The coin bank defined in claim 1 wherein said chute includes a pair of protrusions for abutting opposing sides of the upper edge of said coin holder and said overflow passage is defined between said pair of protrusions.

5. The coin bank defined in claim 1 further comprising a sorter for sorting coins of different diameters and conveying coins of a specific diameter to said coin chute.

6. The coin bank defined in claim 1 wherein said coin holder is cylindrical having an open upper end defined by said top edge for receiving coins and an at least partially closed lower end.

7. The coin bank defined in claim 6 wherein said protrusion accommodates generally orthogonal movement of said coin holder as said coin holder is brought into alignment with said coin chute.

8. The coin bank defined in claim 1 further comprising a coin tray selectively mounted to said housing, wherein said coin holder is removably disposed in said coin tray.

9. The coin bank defined in claim 8 wherein said coin tray includes an overflow bin for receiving said coins passing through said overflow passage.

10. A coin bank, said coin bank comprising:

a housing;

a coin tray selectively mounted to said housing;

a coin holder disposed in said coin tray; and a coin chute accommodating coins of a specific diameter and aligned with said coin holder for conveying coins thereto, said coin chute including at least one protrusion extending therefrom for abutting the top edge of said coin holder to maintain said alignment.

11. The coin bank defined in claim 10 further including a sorter for sorting coins of different diameters and conveying coins of a specific diameter to said coin chute.

12. The coin bank defined in claim 11 further comprising:

a plurality of coin holders each having a top edge defining an open upper end for receiving coins of a respective maximum diameter and at least a partially closed lower end; and a plurality of coin chutes each accommodating sorted coins of a respective maximum diameter received from said sorter, wherein each of said plurality of coin holders is removably aligned with a corresponding one of said plurality of coin chutes for receiving said sorted coins therefrom, said plurality of coin chutes each including at least one protrusion for abutting said top edge of said corresponding coin holder for maintaining said alignment while coins are conveyed thereto and for accommodating the displacement of said corresponding coin holder from said alignment for removing coins therefrom.

13. The coin bank defined in claim 12 wherein said protrusion is a finger.

14. The coin bank defined in claim 12 wherein each of said plurality of coin holders is adapted to hold a respective predetermined number of coins, and each of said plurality of coin chutes further comprises a separate overflow passage for allowing coins in excess of said predetermined number to pass therethrough when said respective coin holder is filled with said respective predetermined number of coins.

15. The coin bank defined in claim 14 wherein each of said plurality of coin chutes includes a pair of protrusions extending therefrom for abutting opposing sides of the top edge of said respective coin holder and said overflow passage is defined between said pair of protrusions.

16. The coin bank defined in claim 12 wherein said coin tray includes an overflow bin for receiving said coins passing through said overflow passages.

17. The coin bank defined in claim 12 wherein said plurality of coin holders are removably disposed in said coin tray.

18. The coin bank defined in claim 17 wherein said plurality of coin holders are cylindrical and said protrusions accommodate orthogonal movement of said plurality of coin holders as each of said plurality of coin holders is brought into alignment with said corresponding coin chute.

19. A coin bank for sorting and storing coins of various diameters, said coin bank comprising:

a housing;

a sorter secured to said housing for sorting coins of different diameters;

a sorted coin holder removably secured to said housing and adapted for holding sorted coins of a specific maximum diameter; and a coin chute accommodating sorted coins of a specific diameter received from said sorter, wherein said sorted coin holder is removably aligned with said coin chute for receiving said sorted coins therefrom, said coin chute including at least one protrusion for abutting the top edge of said sorted coin holder for maintaining said alignment while coins are conveyed thereto and for accommodating the displacement of said sorted coin holder from said alignment for the removal of coins therefrom, said coin chute further including an overflow passage defined in a wall of said chute for allowing said sorted coins to pass therethrough when said coin holder is full.

20. The coin bank defined in claim 19 wherein said coin chute includes a pair of protrusions for abutting opposing sides of said top edge of said sorted coin holder and said overflow passage is defined between said pair of protrusions.

21. The coin bank defined in claim 19 further including a coin tray selectively mounted to said housing, wherein said sorted coin holder is disposed in said coin tray.

22. The coin bank defined in claim 19 further comprising:

a plurality of sorted coin holders each having a top edge defining an open upper end for receiving coins of a respective maximum diameter and at least a partially closed lower end; and a plurality of coin chutes each accommodating sorted coins of a respective maximum diameter received from said sorter, wherein each of said plurality of sorted coin holders is removably aligned with a corresponding one of said plurality of coin chutes for receiving said sorted coins therefrom, said plurality of coin chutes each including at least one protrusion for abutting said top edge of said corresponding sorted coin holder for maintaining said alignment while said sorted coins are conveyed thereto and for accommodating the displacement of said sorted coin holder from said alignment for the removal of said sorted coins therefrom, said plurality of coin chutes each further including a wall having an overflow passage for allowing said sorted coins to pass therethrough when said respective sorted coin holder is full.

23. A coin bank for sorting and storing coins of various sizes, said coin bank comprising:

a housing having a light transmitting portion for allowing light to pass therethrough;

a separator and sorter mechanism disposed in said housing; and a light emitting device disposed within said housing for providing illumination of said separator and sorter mechanism which is visible from outside of said housing.

24. The coin bank defined in claim 23 wherein said housing includes indicia visually enhanced by said light emitting device.

25. The coin bank defined in claim 23 wherein said light emitting device is a light bulb.

26. The coin bank defined in claim 23 wherein said light emitting device is a light emitting diode.

27. A coin bank for sorting and storing coins of various sizes, said coin bank comprising:

a housing;

a sorter secured to said housing and including a plurality of different sized apertures for sorting the associated coins by diameter;

a separator supported by said housing;

an electric motor for moving said separator to convey the associated coins individually to said sorter;

a light emitting device connected to said housing; and a switch for activating said electric motor and said light emitting device.

28. The coin bank defined in claim 27 wherein said housing includes a light transmitting portion for allowing light to pass therethrough.

29. The coin bank defined in claim 28 wherein said housing includes indicia which are visually enhanced by said light emitting device.

30. The coin bank defined in claim 28 wherein said light emitting device is disposed within said housing.

31. The coin bank defined in claim 27 wherein said light emitting device is a light bulb.

32. The coin bank defined in claim 27 wherein said light emitting device is a light emitting diode.

33. The coin bank defined in claim 27 wherein said switch simultaneously activates said electric motor and said light emitting device.

34. A coin bank for sorting and storing coins of various sizes, said coin bank comprising:

a housing including a movable portion, said housing further including a light transmitting portion for allowing light to pass therethrough;

a light emitting device disposed within said housing for providing illumination which is visible from outside of said housing; and a switch supported by said housing for activating said light emitting device when said movable portion is moved.

35. The coin bank defined in claim 34 wherein said housing includes indicia which are visually enhanced by said light emitting device.

36. The coin bank defined in claim 34 wherein said light emitting device is a light bulb.

37. The coin bank defined in claim 34 wherein said light emitting device is a light emitting diode.

38. The coin bank defined in claim 34 wherein said movable portion is adapted for rotational movement.

39. The coin bank defined in claim 38 further including a protrusion extending from said movable portion for contacting said switch to activate said light emitting device when said movable portion is rotated.

40. The coin bank defined in claim 39 wherein said movable portion of said housing is a lid.

* * * * *